US012698178B2

(12) United States Patent
Marchek et al.

(10) Patent No.: US 12,698,178 B2
(45) Date of Patent: Aug. 4, 2026

(54) CABLE REEL ASSEMBLIES AND SUB-ASSEMBLIES

(71) Applicant: AFL Telecommunications LLC, Duncan, SC (US)

(72) Inventors: Kyle Marchek, Greer, SC (US); Raul Reyes Hernandez, Nuevo Leon (MX)

(73) Assignee: AFL Telecommunications LLC, Duncan, SC (US)

( * ) Notice: Subject to any disclaimer, the term of this patent is extended or adjusted under 35 U.S.C. 154(b) by 196 days.

(21) Appl. No.: 18/785,191

(22) Filed: Jul. 26, 2024

(65) Prior Publication Data

US 2025/0282572 A1 Sep. 11, 2025

Related U.S. Application Data

(60) Provisional application No. 63/562,447, filed on Mar. 7, 2024.

(51) Int. Cl.
*B65H 49/20* (2006.01)
*B65H 75/30* (2006.01)

(52) U.S. Cl.
CPC ..... *B65H 49/205* (2013.01); *B65H 75/30* (2013.01)

(58) Field of Classification Search
CPC ..... B65H 49/205; B65H 75/14; B65H 75/30; B65D 85/672
See application file for complete search history.

(56) References Cited

U.S. PATENT DOCUMENTS 4,108,305 A * 8/1978 Komatu ..... B65D 85/672 206/715
5,022,577 A * 6/1991 Fike ..... B65H 49/205 225/46
5,803,255 A * 9/1998 Peeters ..... B65D 85/672 206/398
10,421,636 B1 * 9/2019 Bigbee, Jr. ..... B65H 75/40
11,111,100 B1 * 9/2021 Bigbee, Jr. ..... B65H 49/32
2002/0121568 A1 9/2002 Malmend
2016/0251196 A1 * 9/2016 Thakare ..... B65H 75/242 242/609

(Continued)

FOREIGN PATENT DOCUMENTS

AU 2019201257 A1 3/2019
EP 1564175 A1 8/2005

OTHER PUBLICATIONS

International Search Report Corresponding to Application No. PCT/US2025/018315 dated Jun. 2, 2025.

*Primary Examiner* — Sang K Kim
(74) *Attorney, Agent, or Firm* — Dority & Manning, P.A.

(57) ABSTRACT

Cable reel assemblies and sub-assemblies are provided. A cable reel sub assembly includes a cable reel that has a first flange, a second flange, and a tubular body that extends between the first flange and the second flange. The first flange and the second flange each define a main opening and flange notches. The cable reel sub-assembly further includes a first pad and a second pad. Each of the first pad and the second pad define a central opening and pad notches. The cable reel sub-assembly further includes a first plug that extends through the central opening of the first pad and the main opening of the first flange. The cable reel sub-assembly further includes a second plug that extends through the central opening of the second pad and the main opening of the second flange.

19 Claims, 6 Drawing Sheets

(56) References Cited

U.S. PATENT DOCUMENTS

| | | | | |
|---|---|---|---|---|
| 2018/0179016 | A1* | 6/2018 | Dunar | B65H 49/205 |
| 2021/0300718 | A1* | 9/2021 | Thakare | B65H 49/205 |
| 2022/0212891 | A1* | 7/2022 | Norton | B65H 75/241 |
| 2023/0219782 | A1* | 7/2023 | Thakare | B65H 75/2416 242/578.2 |

* cited by examiner

CABLE REEL ASSEMBLIES AND SUB-ASSEMBLIES

CROSS-REFERENCE TO RELATED APPLICATIONS

This application is a non-provisional application claiming the benefit of priority under 35 U.S.C. § 119(e) to U.S. Provisional Application No. 63/562,447, filed Mar. 7, 2024, which is hereby incorporated by reference in its entirety.

FIELD

The present disclosure relates generally to improved reel assemblies for cables, such as optical fiber cables or other cables.

BACKGROUND

Reels are generally utilized for the transport and deployment of various products such as cables. In particular, electrical and optical fiber cables are frequently transported and deployed via reels. Typically, such cables are manufactured and stored on reels for transport to a customer, and the customer disposes of or returns the reel after deployment of the cable.

During the installation of cables in data centers, known cable reels must be removed from a shipping box. The reel requires reel holders for de-spooling the assemblies and additional locking equipment for selectively locking the reel. The installer spends time setting up the de-spooling equipment before the cable can be de-spooled from the reel. Additionally, if the reel is to be locked or restricted from movement, additional equipment is also necessary.

Accordingly, improved cable reel assemblies and sub-assemblies which meet the above requirements and address the above issues are desired and would be advantageous.

BRIEF DESCRIPTION

Aspects and advantages of the cable reel assemblies and sub-assemblies in accordance with the present disclosure will be set forth in part in the following description, or may be obvious from the description, or may be learned through practice of the technology.

In accordance with one embodiment, a cable reel sub-assembly is provided. The cable reel sub assembly includes a cable reel that has a first flange, a second flange, and a tubular body that extends between the first flange and the second flange. The first flange and the second flange each define a main opening and flange notches. The cable reel sub-assembly further includes a first pad and a second pad. Each of the first pad and the second pad define a central opening and pad notches. The cable reel sub-assembly further includes a first plug that extends through the central opening of the first pad and the main opening of the first flange. The cable reel sub-assembly further includes a second plug that extends through the central opening of the second pad and the main opening of the second flange.

In accordance with another embodiment, a cable reel assembly is provided. The cable reel assembly includes a corrugated container that defines an interior and includes a flap. The cable reel assembly further includes a cable reel sub-assembly positioned within the interior of the corrugated container. The cable reel sub assembly includes a cable reel that has a first flange, a second flange, and a tubular body that extends between the first flange and the second flange. The first flange and the second flange each define a main opening and flange notches. The cable reel sub-assembly further includes a first pad and a second pad. Each of the first pad and the second pad define a central opening and pad notches. The cable reel sub-assembly further includes a first plug that extends through the central opening of the first pad and the main opening of the first flange. The cable reel sub-assembly further includes a second plug that extends through the central opening of the second pad and the main opening of the second flange.

In accordance with another embodiment, a method of locking a cable reel assembly is provided. The method includes moving a cable reel relative to a first pad and a second pad until a pad notch defined on one of the first pad and the second pad aligns with a flange notch defined on a flange of the cable reel. The method further includes inserting a flap of a corrugated container into the pad notch and the flange notch to restrict movement between the cable reel and the first and second pads.

These and other features, aspects and advantages of the present cable reel assemblies and sub-assemblies will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present cable reel assemblies and sub-assemblies, including the best mode of making and using the present systems and methods, directed to one of ordinary skill in the art, is set forth in the specification, which makes reference to the appended figures, in which.

DETAILED DESCRIPTION

Figure 3:
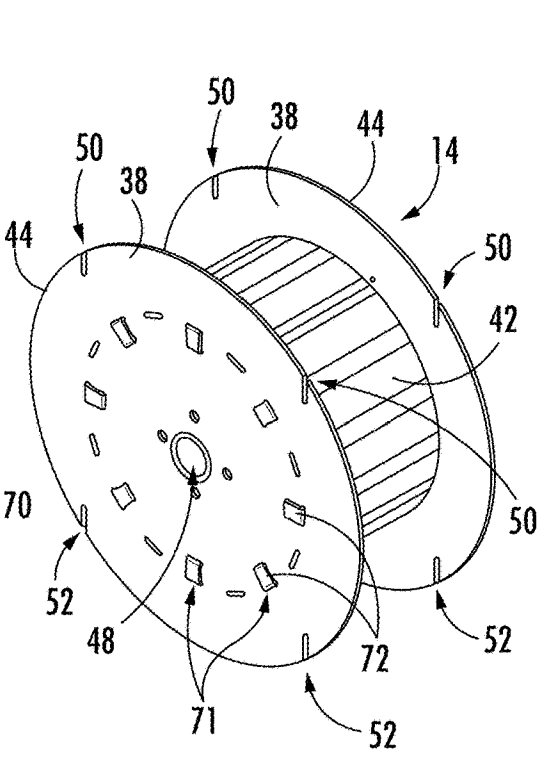
FIG. 3 illustrates a perspective view of a cable reel in accordance with exemplary aspects of the present disclosure.

Reference now will be made in detail to embodiments of the present cable reel assemblies and sub-assemblies, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components.

The term "fluid" may be a gas or a liquid. The term "fluid communication" means that a fluid is capable of making the connection between the areas specified.

The term "radially" refers to the relative direction that is substantially perpendicular to an axial centerline of a particular component, the term "axially" refers to the relative direction that is substantially parallel and/or coaxially aligned to an axial centerline of a particular component and the term "circumferentially" refers to the relative direction that extends around the axial centerline of a particular component.

Terms of approximation, such as "about," "approximately," "generally," and "substantially," are not to be limited to the precise value specified. In at least some instances, the approximating language may correspond to the precision of an instrument for measuring the value, or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. When used in the context of an angle or direction, such terms include within ten degrees greater or less than the stated angle or direction. For example, "generally vertical" includes directions within ten degrees of vertical in any direction, e.g., clockwise or counter-clockwise.

The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive- or and not to an exclusive-or. For example, a condition A or B is satisfied by any one of the following: A is true (or present) and B is false (or not present), A is false (or not present) and B is true (or present), and both A and B are true (or present).

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

Figure 2:
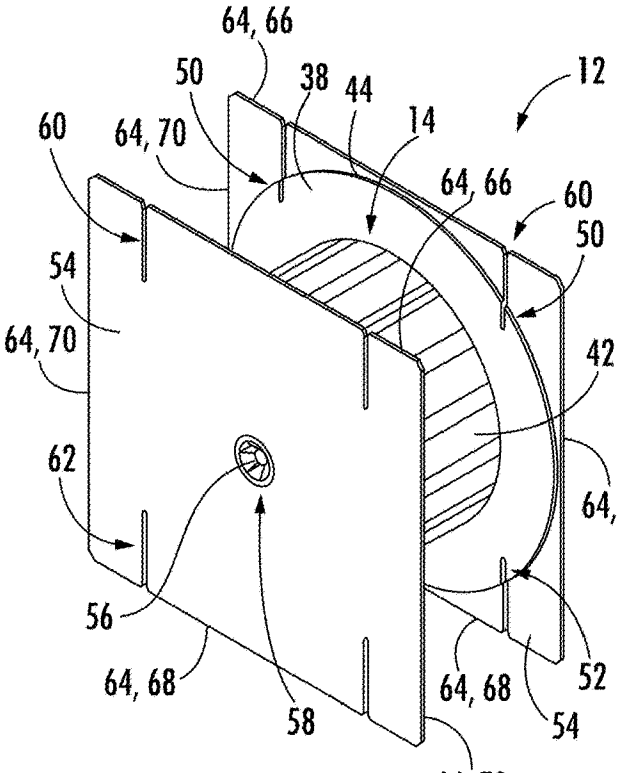
FIG. 2 illustrates a perspective view of a cable reel sub-assembly in accordance with embodiments of the present disclosure.
Figure 1:
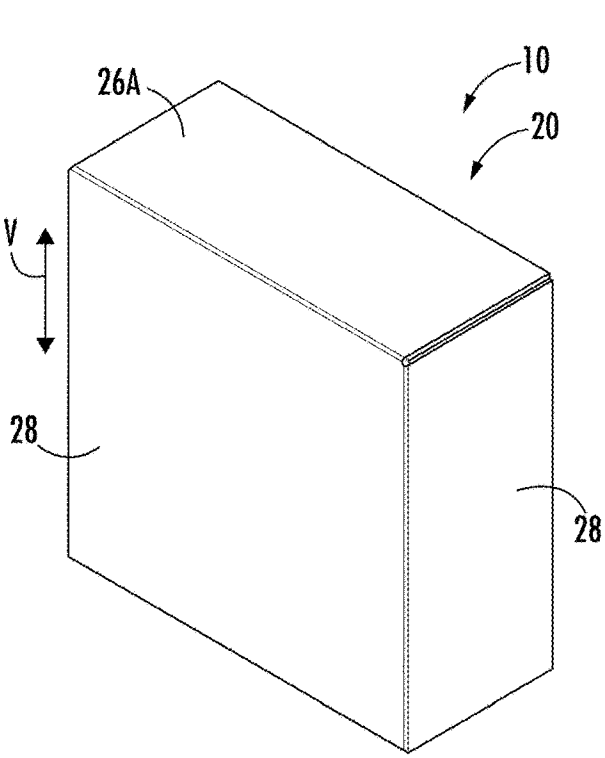
FIG. 1 illustrates a perspective view of a cable reel assembly in accordance with embodiments of the present disclosure.
Figure 5:
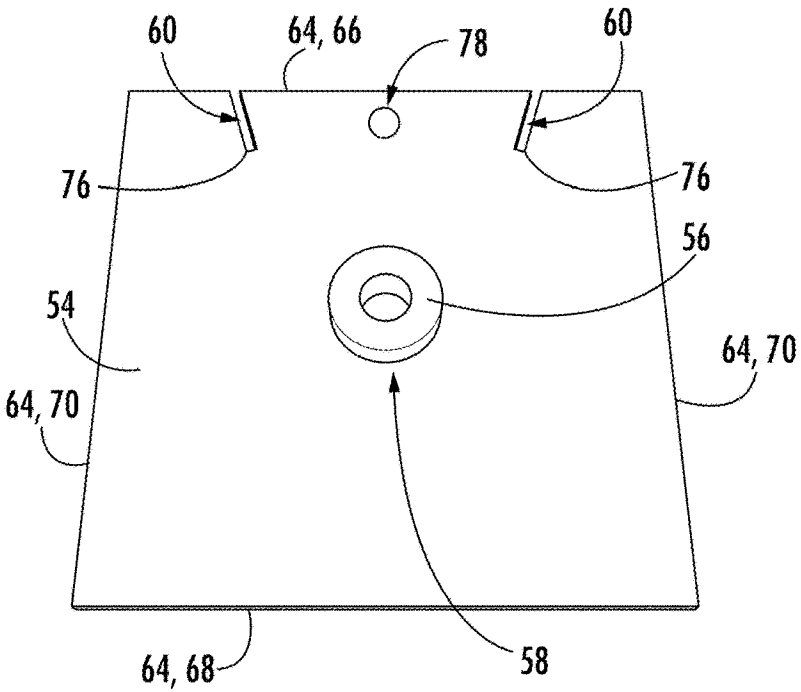
FIG. 5 illustrates a side view of a pad coupled to a plug in accordance with exemplary aspects of the present disclosure.
Figure 4:
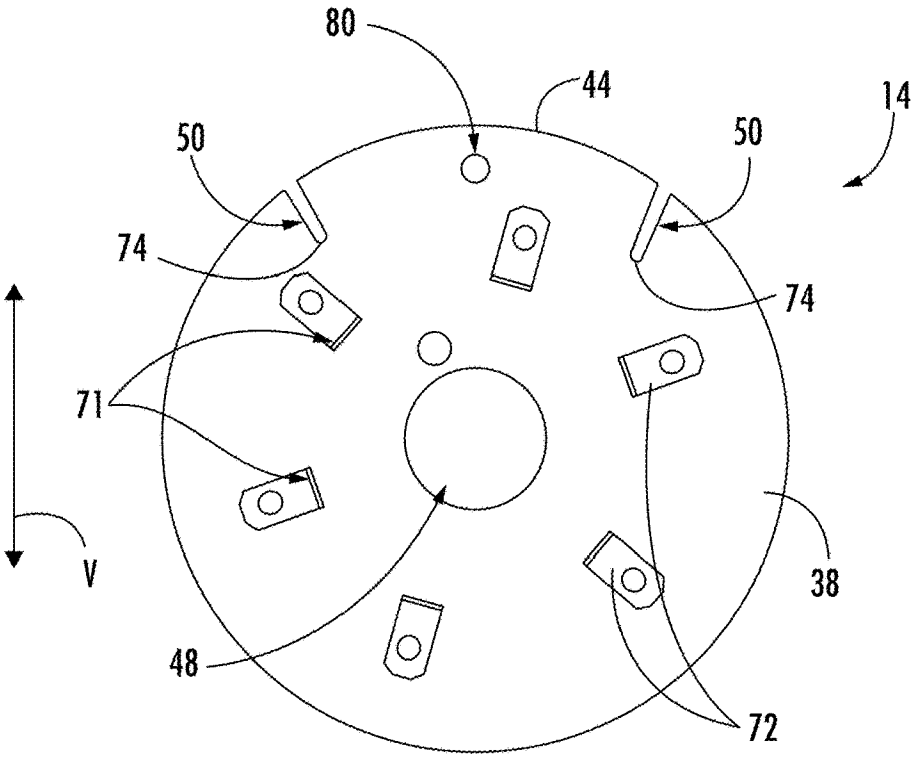
FIG. 4 illustrates a side view of a cable reel in accordance with exemplary aspects of the present disclosure.
Figure 7:
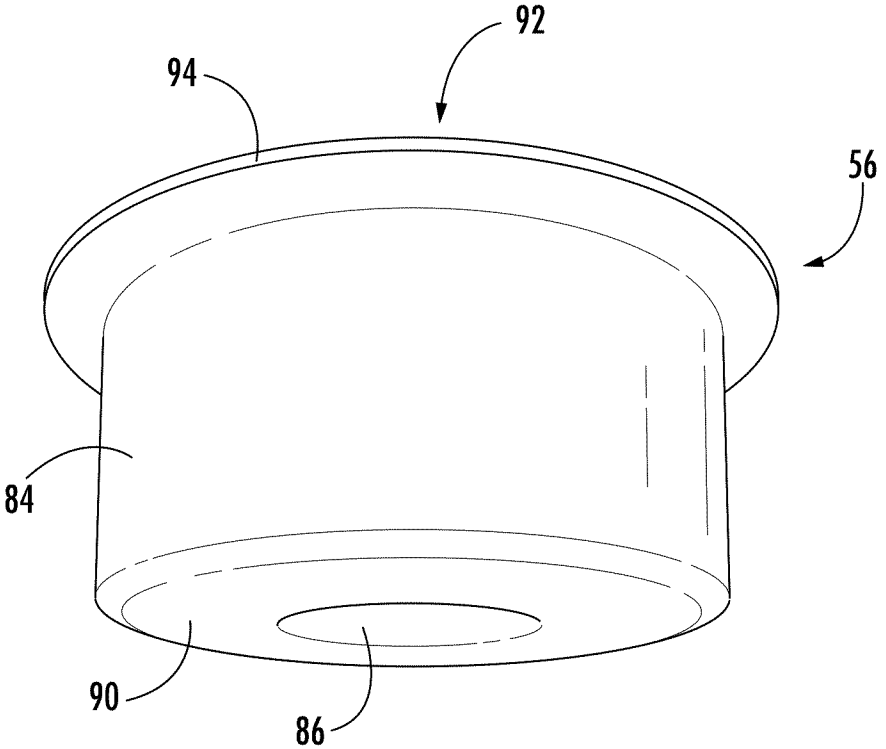
FIG. 7 illustrates a perspective view of a plug in accordance with exemplary aspects of the present disclosure.
Figure 6:
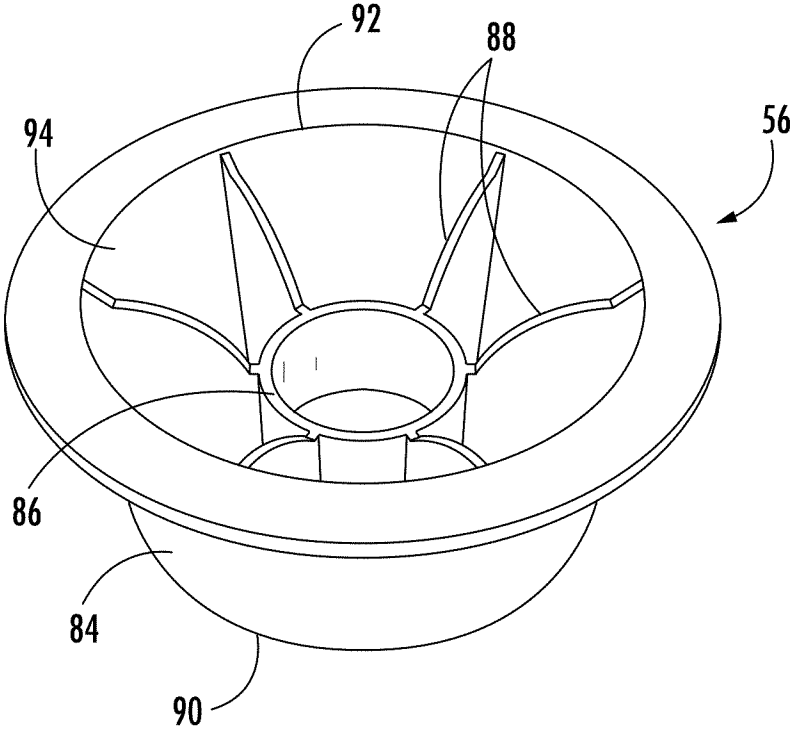
FIG. 6 illustrates a perspective view of a plug in accordance with exemplary aspects of the present disclosure.

Referring now to the drawings, FIGS. 1 through 9 illustrate a cable reel assembly 10 and components thereof in accordance with embodiments of the present disclosure. A cable reel assembly 10 in accordance with the present disclosure may advantageously be utilized to transport and deploy cables, such as electrical or fiber optic cables or other cables. Particularly, FIG. 1 illustrates a perspective view of a cable reel assembly 10; FIG. 2 illustrates a perspective view of a cable reel sub-assembly 12; FIG. 3 illustrates a perspective view of a cable reel 14; FIG. 4 illustrates a side view of a cable reel 14; FIG. 5 illustrates a side view of a pad 54 connected to a plug 56; FIG. 6 illustrates a first perspective view of the plug 56; FIG. 7 illustrates a second perspective view of the plug 56; and FIGS. 8 and 9 each illustrate a perspective view of a cable reel assembly 10 in a restricted position.

Figure 9:
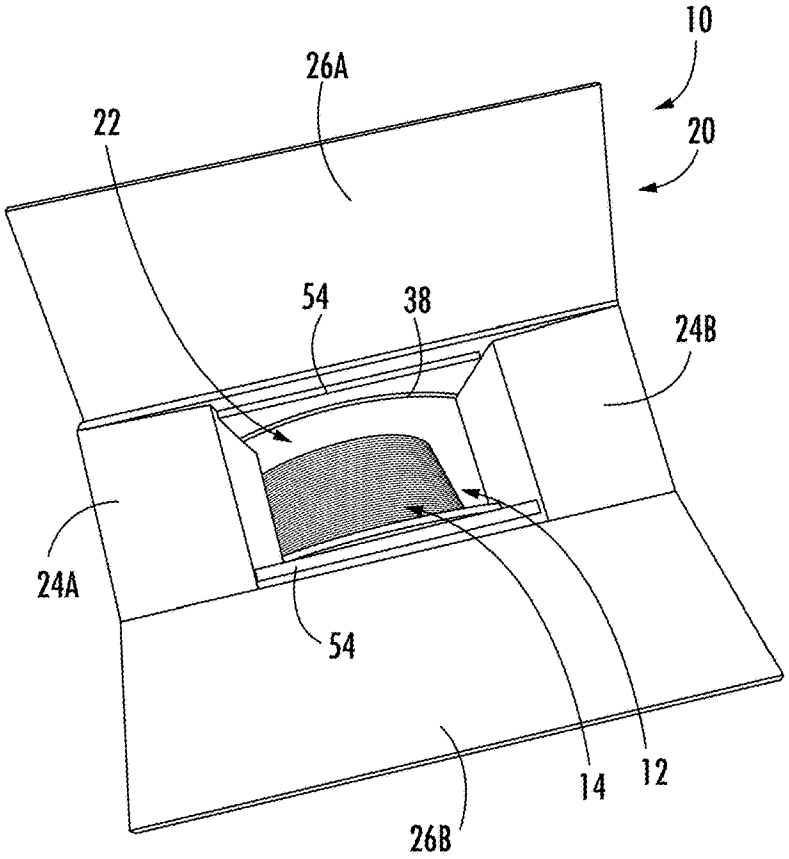
FIG. 9 illustrates a perspective view of a cable reel assembly in accordance with embodiments of the present disclosure.
Figure 8:
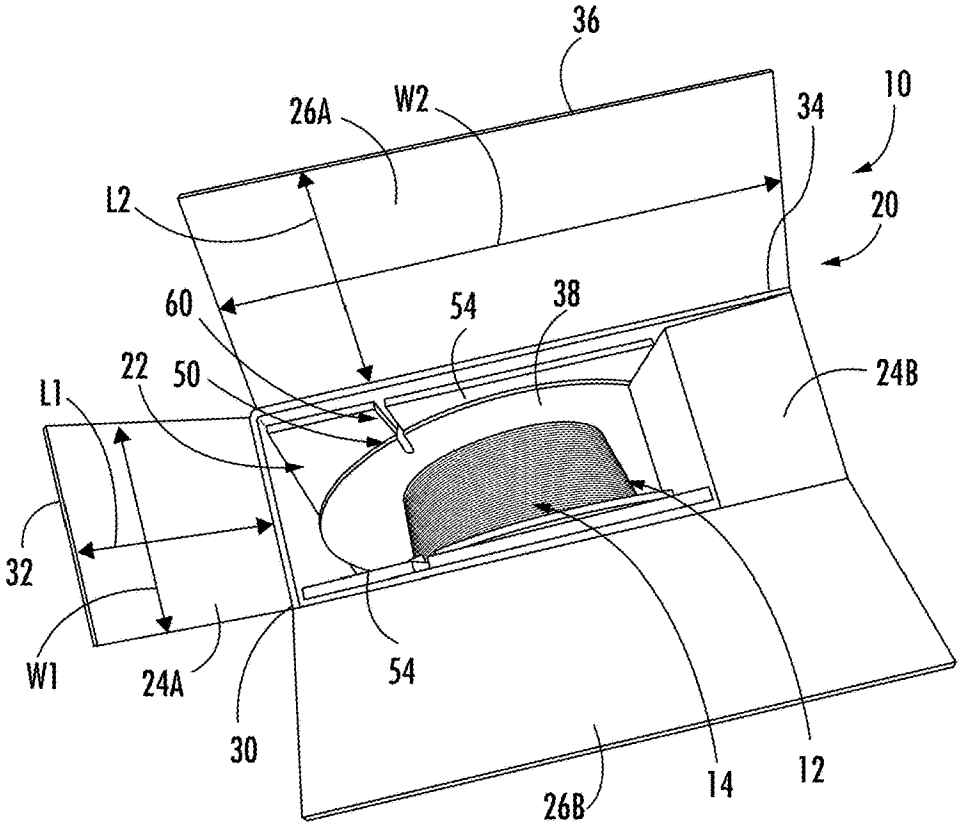
FIG. 8 illustrates a perspective view of a cable reel assembly in accordance with embodiments of the present disclosure.

The cable reel assembly 10 (FIG. 1) may include a corrugated container 20 that defines an interior 22 (FIGS. 8 and 9) and includes one or more flaps 24A, 24B, 26A, 26B (FIGS. 8 and 9). Particularly, the corrugated container 20 may include one or more side walls 28, and the one or more flaps 24A, 24B, 26A, 26B may each extend from one or more side walls 28 to a terminal end. The one or more side walls 28 may be mutually perpendicular to one another. As shown in FIGS. 8 and 9, the corrugated container 20 may include inner flaps 24A, 24B (such as a first inner flap 24A and a second inner flap 24B) and outer flaps 26A, 26B (such as a first outer flap 26A and a second outer flap 26B). The inner flaps 24A, 24B may have a smaller width than the outer flaps 26A, 26B. The outer flaps 26A, 26B and the inner flaps 24A, 24B may be pivotable relative to the side walls 28 from which they extend to provide for selective access to the interior 22. For example, the outer flaps 26A, 26B and the inner flaps 24A, 24B may be movable to an open position that provides an opening to access the interior 22 of the corrugated container 20 (as shown in FIGS. 8 and 9).

In various embodiments, the corrugated container 20 may be one of a paper corrugated container (e.g., cardboard) or a plastic corrugated container. In this way, the corrugated container 20 may be formed from a compliant material, such that the flaps 24A, 24B, 26A, 26B may be bendable and/or flexible. In various embodiments, the corrugated container 20 may be one of a regular slotted container (RSC), a half slotted container (HSC), an overlap slotted container (OSC), a full overlap slotted container (FOL), A center special slotted container (CSSC), or other suitable corrugated container. The corrugated container 20 may be formed from a single sheet of corrugated material (such as paper, cardboard, or plastic) that is cut and scored to form the corrugated container 20 having the flaps 24A, 24B, 26A, 26B that provide for selective access to the interior 22.

In many embodiments, the cable reel 14, including the flanges 38 and the tubular body 42, may be formed from a corrugated material (such as a corrugated paper or corrugated plastic). In various embodiments, the cable reel 14 may be formed from corrugated material (such as corrugated paper or corrugated plastic). Forming both the cable reel 14 and the corrugated container from paper and/or plastic advantageously allows for the components to be recycled once the deployment of a cable is complete.

As shown in FIG. 8, the inner flaps 24A, 24B may extend the full width of the corrugated container but may not extend the full length of the corrugated container 20. For example, the inner flaps 24A, 24B may each define a length L1 and a width W1 mutually perpendicular to one another. The length L1 may be defined from a base 30 (e.g., where the inner flap 24A, 24B intersects with the side wall 28 of the corrugated container 20) of the inner flap 24A, 24B to a terminal end 32 of the inner flap 24A, 24B. The length L1 may be less than a length of the corrugated container 20, such that the inner flaps 24A, 24B do not overlap and do not collectively enclose the interior 22 when in a folded position. The width W1 may extend the entire width of the corrugated container 20 (e.g., between two side walls 28).

The outer flaps 26A, 26B may extend the full length and the full width of the corrugated box 20. For example, the outer flaps 26A, 26B may each define a length L2 and a width W2 mutually perpendicular to one another. The length L2 may be defined from a base 34 (e.g., where the outer flap 26A, 26B intersects with the side wall 28 of the corrugated container 20) of the outer flap 26A, 26B to a terminal end 36 of the outer flap 26A, 26B. The length L2 may be generally equal to a width of the corrugated container 20, such that the outer flaps 26A, 26B extend across the entire width of the corrugated container 20, overlap with one another, and enclose the interior 22 when in a folded position. The width W2 may extend the entire length of the corrugated container 20 (e.g., between two side walls 28).

Referring back to FIGS. 2 and 3, a cable reel sub-assembly 12, which includes a cable reel 14, may be included in the cable reel assembly 10. For example, as shown in FIGS. 8 and 9, the cable reel-sub assembly 12 may be positioned within the interior 22 of the corrugated container 20. The cable reel sub assembly 12 may be selectively removable from the interior 22 by adjusting the flaps 24A, 24B, 26A, 26B to an open position to create an opening to the interior 22 and sliding the cable reel sub-assembly 12 out of the opening.

As shown in FIGS. 2 and 3, the cable reel sub-assembly 12 may include the cable reel 14. The cable reel 14 may include flanges 38 and a tubular body 42 extending between the flanges 38. Particularly, the cable reel 14 may include a first flange 38, a second flange 38, and a tubular body 42 extending between the first flange 38 and the second flange 38. The flanges 38 may each define a periphery 44 (or edge) that is round (e.g., a circle, oval, or other shape having a continuous curvature). The tubular body 42 may extend between the first flange 38 and the second flange 38, and the tubular body 42 may have a diameter that is less than a diameter of the first flange 38 and the second flange 38. In operation, a cable may be wound about the tubular body 42 between the flanges 38. In this way, the flanges 38 having a larger diameter than the tubular body 42 is advantageous because it prevents the cable from sliding off the tubular body 42.

As shown in FIG. 3, the flanges 38 may each define a main opening 48 (only one shown). The main opening 48 may be circular (however, other shapes may be possible). The main opening 48 may be centered on each of the first flange 38 and the second flange 38 (e.g., geometrically centered). For example, the first flange 38 and the second flange 38 may be circularly shaped, and the main opening 48 may be centered on the circle, which advantageously provides for uniform rotation of the cable reel 14 when winding or unwinding cable from the tubular body 42.

Additionally, each of the first flange 38 and the second flange 38 may define flange notches 50, 52. Particularly, the first flange 38 and the second flange 38 may each define a pair of outer flange notches 50 and a pair of inner flange notches 52. The pair of outer flange notches 50 and the pair of inner flange notches 52 may each extend from a respective periphery 44 of a respective flange 38. For example, for the first flange 38, the pair of outer flange notches 50 may extend from the first periphery 44, and the pair of inner flange notches 52 may extend from the first periphery 44. Similarly, for the second flange 38, the pair of outer flange notches 50 may extend from the second periphery 44, and the pair of inner flange notches 52 may extend from the second periphery 44.

The pair of outer flange notches 50 may be spaced apart from one another and disposed on opposite sides of the main opening 48. In other words, the main opening 48 may be disposed between (e.g., directly between) the pair of outer flange notches 50. That is, the main opening 48 may be disposed equidistant from each outer flange notch in the pair of outer flange notches 50. Similarly, the pair of inner flange notches 52 may be spaced apart from one another and disposed on opposite sides of the main opening 48. In other words, the main opening 48 may be disposed between (e.g., directly between) the pair of inner flange notches 52. That is, the main opening 48 may be disposed equidistant from each inner flange notch in the pair of outer flange notches 52.

Referring now to FIG. 2, the cable reel sub-assembly 12 may further include pads 54 and plugs 56 that rotatably couple the pads 54 to the respective flange 38. For example, the cable reel sub-assembly 12 may include a first pad 54 and a second pad 54 spaced apart from one another and each disposed adjacent to a respective flange 38. For example, the first pad 54 may be coupled to the first flange 38 via a first plug 56, and the second pad 54 may be coupled to the second flange 38 via a second plug 56. The pads 54 may each define a central opening 58. When assembled, as shown in FIG. 2, a plug 56 may be extend through the central opening 58 of a pad 54 and the main opening 48 of a flange 38 to couple the pad 54 to the flange 38. More specifically, a first plug 56 may extend through the first central opening 58 of the first pad 54 and the first main opening 48 of the first flange 38 to couple the first pad 54 to the first flange 38. Similarly, the second plug 56 may extend through the second central opening 58 of the second pad 54 and the second main opening 48 of the second flange 38 to couple the second pad 54 to the second flange 38. The cable reel 14 may be rotatable about the plugs 56 relative to the pads 54 to spool or unspool cable as desired.

The pads 54 may each define pad notches 60, 62 that are alignable with the flange notches 50, 52 (as shown in FIG. 2) by rotating the cable reel 14 about the plugs 56 relative to the pads 54. Specifically, the pads 54 may each define a pair of outer pad notches 60 and a pair of inner pad notches 62. The pair of outer pad notches 60 may be alignable with the pair of outer flange notches 50. More specifically, the pair of outer pad notches 60 in the first pad 54 may be alignable with the pair of outer flange notches 50 in the first flange 38, and the pair of outer pad notches 60 in the second pad 54 may be alignable with the pair of outer flange notches 50 in the second flange 38. The pair of inner pad notches 62 may be alignable with the pair of inner flange notches 52. More specifically, the pair of inner pad notches 62 in the first pad 54 may be alignable with the pair of inner flange notches 52 in the first flange 38, and the pair of inner pad notches 62 in the second pad 54 may be alignable with the pair of inner flange notches 52 in the second flange 38.

The first pad 54 and the second pad 54 may each define an edge 64 (at which the pads terminate). In the exemplary embodiment shown, the pads 54 may be shaped as a square or rectangle (e.g., having four edges, which may be equally sized). However, in other embodiments, the pads 54 may have another shape, such as any polygonal shape (having any number of edges). In the embodiment shown, the first pad 54 and the second pad 54 may each include an outer edge 66, an inner edge 68, and side edges 70 extending between the outer edge 66 and the inner edge 68. The pad notches may. The pad notches 60, 62 may extend from the edge 64 of each of the first pad 54 and the second pad 54. Specifically, the outer pad notches 60 may extend from the outer edge 66, and the inner pad notches 62 may extend from the inner edge 68.

As shown in FIG. 3, the flanges 38 may each define a plurality of slots 71 extending about the main opening 48. In such embodiments, the tubular reel 42 may include a plurality of foldable tabs 72 that each extend through a respective slot of the plurality of slots 71 to couple the flanges 38 to the tubular reel 42. However, other means of coupling the tubular reel 42 to the flanges 38 may be possible and the present disclosure should not be limited to one particular means for coupling these components unless specifically recited in the claims.

Referring now specifically to FIGS. 4 and 5, a side view of a cable reel 14 (FIG. 4) and a side view of a pad 54 coupled to a plug 56 (FIG. 5) are illustrated in accordance with exemplary aspects of the present disclosure. As shown, the cable reel 14 may include a flange 38 having a circular periphery 44. The main opening 48 may be defined in a center of the flange 38. The flange 38 may define a plurality of slots 71 that at least partially surround the main opening 48. A plurality of foldable tabs 72 of the tubular reel 42 may extend through the plurality of slots 71 to couple the tubular reel to the flange 38.

As shown in FIG. 4, in some embodiments, the flange notches 50 may each extend from the periphery 44 towards the main opening 48 to an end 74. That is, the flange notches 50 may be angled (e.g., relative to a vertical direction V, which may be aligned with the direction of gravity) such that they extend towards from the periphery 44 towards the main opening 48 to the end 74. In other embodiments, as shown in FIGS. 2 and 3, the flange notches 50 may extend entirely vertically (e.g., parallel to the side edges 70 and perpendicular to the inner edge 68 and the outer edge 66).

As shown in FIG. 5, the pad 54 may be shaped generally rectangularly shaped (such as a square in many embodiments) having edges 64. Particularly, the pad 54 may include an outer edge 66 and an inner edge 68 spaced apart from one another. Side edges 70 may extend between the outer edge 66 and the inner edge 68. A central opening 58 may be defined through a center of the pad 54, and the plug 56 may extend through the central opening 58 (and into the main opening 48 of the flange 38 when fully assembled).

As shown in FIG. 5, the pad notches 60 may each extend from the edge 64 (such as the outer edge 66) towards the central opening 58 to an end 76. That is, the pad notches 60 may be angled (e.g., relative to a vertical direction V, which may be aligned with the direction of gravity) such that they extend towards from the edge 64 towards the central opening 58 to the end 76. In other embodiments, as shown in FIGS. 2 and 3, the flange notches 50 may extend entirely vertically (e.g., parallel to the side edges 70 and perpendicular to the inner edge 68 and the outer edge 66).

Additionally, as shown in FIGS. 4 and 5, in many embodiments, the flange 38 and the pad 54 may each define a fastener hole through which a fastener may extend to lock the cable reel 14 from movement relative to the pad 54. For example, at least one of the first pad 54 and the second pad 54 may define a pad fastener hole 78 (FIG. 5), and at least one of the first flange 38 and the second flange 38 may define a flange fastener hole 80 (FIG. 4) that is alignable with the pad fastener hole 78. The pad fastener hole 80 may be disposed between the flange notches 50 closer to the periphery 44 than the main opening 48. Similarly, the pad fastener hole 78 may be disposed between the pad notches 60 closer to an edge 64 (e.g., the outer edge 66) than the central opening 58.

When the pad 54 is coupled to the flange 38 via the plug 56, the cable reel 14 may be rotated about the plug 56 relative to the pad 54 until the pad fastener hole 78 aligns with the flange fastener hole 80. Subsequently, a fastener may be inserted through the pad fastener hole 78 and the flange fastener hole 80 to restrict (or entirely prevent) the cable reel 14 from moving relative to the pad 54. In exemplary implementations, the cable wound about the cable reel 14 may be wrapped in a poly tube plastic. Excess poly tube plastic may be forced through the holes 78, 80 to lock the cable reel 14. In other implementations, a fastener (such as a bolt, screw, zip tie, or other fastener) may be inserted through the holes 78, 80 to lock the cable reel 14 relative to the pad 54.

Referring now specifically to FIGS. 6 and 7, two different perspective views of a plug 56 are illustrated in accordance with exemplary aspects of the present disclosure. As shown, the plug 56 may include an outer ring 84 and an inner ring 86 spaced apart from the outer ring 84. A plurality of ribs 88 may extend between the outer ring 84 and the inner ring 86. The outer ring 84 and the inner ring 86 may extend between a base 90 and a tip 92. A lip 94 may extend outwardly (e.g., radially outwardly) from the outer ring 84 at the tip 92.

Referring now specifically to FIGS. 8 and 9, two perspective views of a cable reel assembly 10 are illustrated in accordance with embodiments of the present disclosure. As shown, the cable reel sub-assembly 12 may be movable between a restricted position (FIGS. 8 and 9) and an unrestricted position (FIG. 2). Particularly, as shown in FIGS. 8 and 9, a flap 24A, 24B may extend into the flange notches 50 and the pad notches 60 such that the cable reel 14 is restricted from movement relative to the first pad 54, the second pad 54, and the corrugated container 20 when in the restricted position. For example, the inner flap(s) 24A, 24B may extend into the flange notches 50 (in both the first and second flanges 38) and the pad notches 60 (in first and second pads 54), which restricts rotational movement of the flanges 38 relative to the pads 54, and which restricts translational movement of the cable reel sub-assembly 12 relative to the corrugated container 20. By contrast, when in the unrestricted position (as shown in FIG. 2), the cable reel may be permitted to move (e.g., rotate about the plugs 56) relative to the first pad 54 and the second pad 54.

Referring back to FIG. 2 briefly, the cable reel 14 is rotatable about the first plug 56 and the second plug 56 relative to the first pad 54 and the second pad 54 between an aligned position (shown in FIG. 2) and an unaligned position. The pad notches 60 are aligned with the flange notches 50 in the aligned position as shown in FIGS. 2, 8, and 9. When in the unaligned position, the cable reel 14 may be rotated relative to the pads 54 such that the flange notches 50 are not aligned with the pad notches 60. Referring now to FIGS. 8 and 9, the inner flaps 24A, 24B may be removably insertable into the flange notches 50 and the pad notches 60 when the cable reel 14 is in the aligned position. This advantageously locks the cable reel 14 relative to the pads 54 and prevents the cable reel sub-assembly 12 from being withdrawn from the interior 22.

Figure 11:
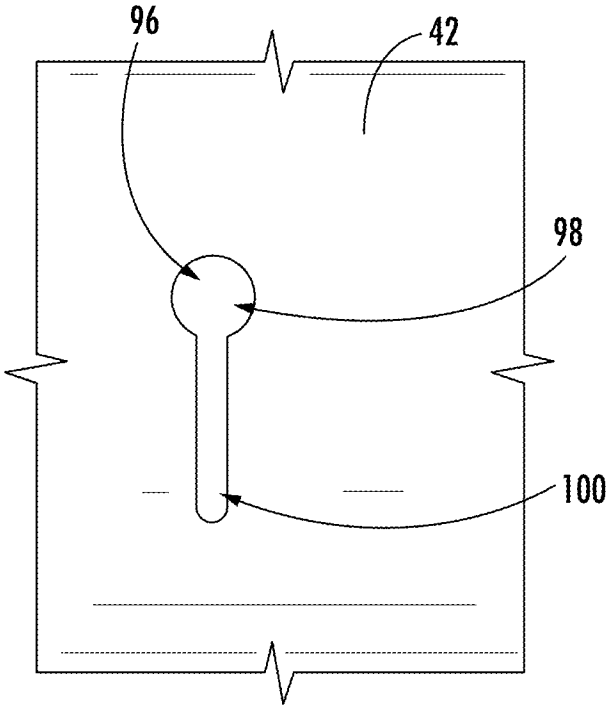
FIG. 11 illustrates an enlarged view of a tubular body with a key hole slot of a cable reel in accordance with exemplary aspects of the present disclosure.
Figure 10:
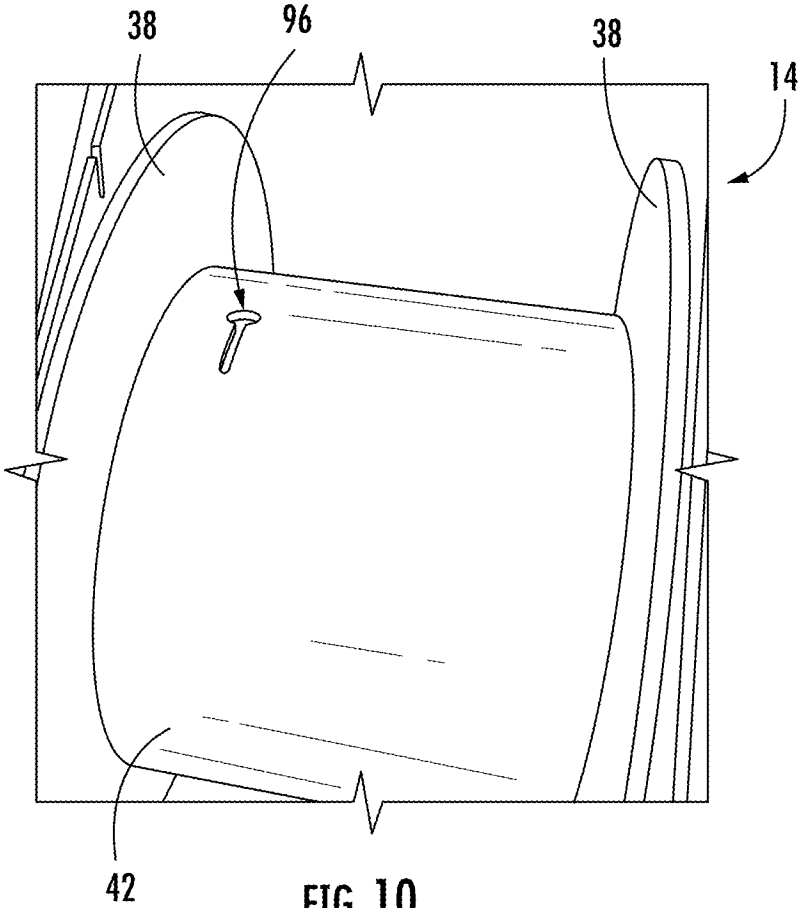
FIG. 10 illustrates a perspective view of a cable reel in accordance with exemplary aspects of the present disclosure.

Referring now to FIGS. 10 and 11, a cable reel 14 and a tubular body 42 are illustrated. Specifically, FIG. 10 illustrates an enlarged perspective view of a cable reel 14, and FIG. 11 illustrates an enlarged view of a portion of a tubular body 42 of the cable reel 14, in accordance with various exemplary aspects of the present disclosure. The cable reel 14 may include flanges 38 and a tubular body 42 extending between, and coupled to, the flanges 38. The tubular body 42 may define a keyhole opening 96. The keyhole opening 96 may be disposed closer to one of the flanges 38 than the other of the flanges 38 (e.g., closer to the first flange than the second flange). As shown in FIG. 11, the keyhole 96 may include an opening portion 98 and a slot portion 100 extending from the opening portion 98. The slot portion 100 may have a longer length than the opening portion 98 and a shorter width than the opening portion 98. In operation, a cable (and/or a portion of poly plastic tube that surrounds the cable) may be inserted into the opening portion 98 of the keyhole slot 96 and slid down the slot portion 100 of the keyhole slot 96. This advantageously prevents the cable from being entirely unspooled from the cable reel 14.

Figure 12:
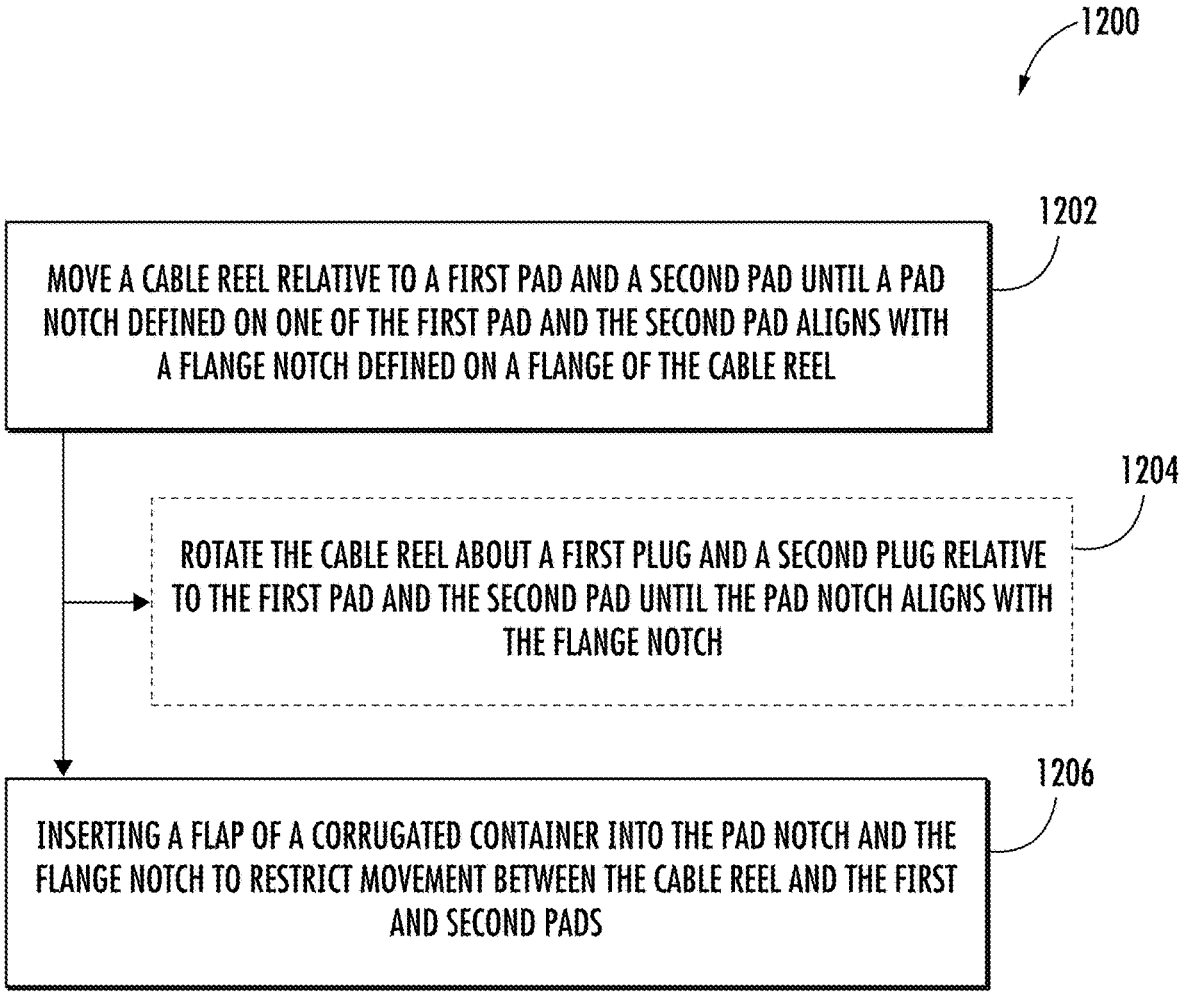
FIG. 12 is a flow chart of a method of locking a cable reel assembly in accordance with embodiments of the present disclosure.

Referring now to FIG. 12, a flow diagram of one embodiment of a method 1200 of locking a cable reel assembly is illustrated in accordance with embodiments of the present subject matter. In general, the method 1200 will be described herein with reference to the cable reel assembly 10, the cable reel sub-assembly 12, and the cable reel 14 described above with reference to FIGS. 1-11. However, it will be appreciated by those of ordinary skill in the art that the disclosed method 1200 may generally be utilized with any other suitable system configuration. In addition, although FIG. 12 depicts steps performed in a particular order for purposes of illustration and discussion, the methods discussed herein are not limited to any particular order or arrangement unless otherwise specified in the claims. One skilled in the art, using the disclosures provided herein, will appreciate that various steps of the methods disclosed herein can be omitted, rearranged, combined, and/or adapted in various ways without deviating from the scope of the present disclosure. Dashed boxes indicate optional steps of the method 1200.

In exemplary implementations, the method 1200 may include at (1202) moving a cable reel relative to a first pad and a second pad until a pad notch defined on one of the first pad and the second pad aligns with a flange notch defined on a flange of the cable reel. In certain implementations, moving at (1202) may further include at (1204) rotating the cable reel about a first plug and a second plug relative to the first pad and the second pad until the pad notch aligns with the flange notch. That is, the cable reel sub-assembly may be movable (or rotatable) between an unaligned position and an aligned position in which the pad notch overlaps with the flange notch to form a single continuous notch into which the flap may be inserted. In many implementations, the method 1200 may further include at (1206) inserting a flap of a corrugated container into the pad notch and the flange notch to restrict (or entirely prevent) movement between the cable reel and the first and second pads.

The cable reel assembly 10 described hereinabove advantageously facilitates the installation of a cable without additional equipment. That is, no de-spooling equipment or cable reel locking equipment is needed. Once the cable is installed, the cable reel assembly 10 can be quickly knocked down and shipped back to the supplier or placed into a recycling container.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are provided by the subject matter of the following clauses:

A cable reel sub-assembly comprising: a cable reel having a first flange, a second flange, and a tubular body extending between the first flange and the second flange, wherein the first flange and the second flange each define a main opening and flange notches; a first pad and a second pad, each of the first pad and the second pad defining a central opening and pad notches; a first plug extending through the central opening of the first pad and the main opening of the first flange; and a second plug extending through the central opening of the second pad and the main opening of the second flange.

The cable reel sub-assembly as in any preceding clause, wherein the cable reel is rotatable about the first plug and the second plug relative to the first pad and the second pad between an aligned position and an unaligned position, wherein the pad notches are aligned with the flange notches in the aligned position.

The cable reel sub-assembly as any preceding clause, wherein the first pad and the second pad each define an edge, wherein the pad notches defined in the first pad and the second pad each extend from a respective edge.

The cable reel sub-assembly as in any preceding clause, wherein the first flange and the second flange each define a periphery, and wherein the flange notches defined in the first flange and the second flange each extend from a respective periphery.

The cable reel sub-assembly as in any preceding clause, wherein at least one of the first pad and the second pad define a pad fastener hole, and wherein at least one of the first flange and the second flange define a flange fastener hole that is alignable with the pad fastener hole.

The cable reel sub-assembly as in any preceding clause, wherein the tubular body defines a keyhole having an opening portion and a slot portion extending from the opening portion.

A cable reel assembly comprising: a corrugated container defining an interior and including a flap; a cable reel sub-assembly positioned within the interior of the corrugated container, the cable reel sub-assembly comprising: a cable reel having a first flange, a second flange, and a tubular body extending between the first flange and the second flange, wherein the first flange and the second flange each define a main opening and flange notches; a first pad and a second pad, each of the first pad and the second pad defining a central opening and pad notches; a first plug extending through the central opening of the first pad and the main opening of the first flange; and a second plug extending through the central opening of the second pad and the main opening of the second flange.

The cable reel assembly as in any preceding clause, wherein the corrugated container is one of a paper corrugated container and a plastic corrugated container.

The cable reel assembly as in any preceding clause, wherein the cable reel sub-assembly is movable between a restricted position and an unrestricted position within the corrugated container.

The cable reel assembly as in any preceding clause, wherein the flap extends into the flange notches and the pad notches such that the cable reel is restricted from movement relative to the first pad and the second pad when in the restricted position.

The cable reel assembly as in any preceding clause, wherein the cable reel is permitted to move relative to the first pad and the second pad when in the unrestricted position.

The cable reel assembly as in any preceding clause, wherein the cable reel is rotatable about the first plug and the second plug relative to the first pad and the second pad between an aligned position and an unaligned position, wherein the pad notches are aligned with the flange notches in the aligned position.

The cable reel assembly as in any preceding clause, wherein the flap is removably insertable into the flange notches and the pad notches when the cable reel is in the aligned position.

The cable reel assembly as in any preceding clause, wherein the first pad and the second pad each define an edge, wherein the pad notches defined in the first pad and the second pad each extend from a respective edge.

The cable reel assembly as in any preceding clause, wherein the first flange and the second flange each define a periphery, and wherein the flange notches defined in the first flange and the second flange each extend from a respective periphery.

The cable reel assembly as in any preceding clause, wherein at least one of the first pad and the second pad define a pad fastener hole, and wherein at least one of the first flange and the second flange define a flange fastener hole that is alignable with the pad fastener hole.

The cable reel assembly as in any preceding clause, wherein the tubular body defines a keyhole having an opening portion and a slot portion extending from the opening portion.

A method of locking a cable reel assembly, the method comprising: moving a cable reel relative to a first pad and a second pad until a pad notch defined on one of the first pad and the second pad aligns with a flange notch defined on a flange of the cable reel; and inserting a flap of a corrugated container into the pad notch and the flange notch to restrict movement between the cable reel and the first and second pads.

The method as in any preceding clause, wherein moving the cable reel further comprises: rotating the cable reel about a first plug and a second plug relative to the first pad and the second pad until the pad notch aligns with the flange notch.

What is claimed is:

1. A cable reel sub-assembly comprising:

a cable reel having a first flange, a second flange, and a tubular body extending between the first flange and the second flange, wherein the first flange and the second flange each define a main opening and flange notches;

a first pad and a second pad, each of the first pad and the second pad defining a central opening and pad notches;

a first plug extending through the central opening of the first pad and the main opening of the first flange; and a second plug extending through the central opening of the second pad and the main opening of the second flange.

2. The cable reel sub-assembly as in claim 1, wherein the cable reel is rotatable about the first plug and the second plug relative to the first pad and the second pad between an aligned position and an unaligned position, wherein the pad notches are aligned with the flange notches in the aligned position.

3. The cable reel sub-assembly as in claim 1, wherein the first pad and the second pad each define an edge, wherein the pad notches defined in the first pad and the second pad each extend from a respective edge.

4. The cable reel sub-assembly as in claim 1, wherein the first flange and the second flange each define a periphery, and wherein the flange notches defined in the first flange and the second flange each extend from a respective periphery.

5. The cable reel sub-assembly as in claim 1, wherein at least one of the first pad and the second pad define a pad fastener hole, and wherein at least one of the first flange and the second flange define a flange fastener hole that is alignable with the pad fastener hole.

6. The cable reel sub-assembly as in claim 1, wherein the tubular body defines a keyhole having an opening portion and a slot portion extending from the opening portion.

7. A cable reel assembly comprising:

a corrugated container defining an interior and including a flap;

a cable reel sub-assembly positioned within the interior of the corrugated container, the cable reel sub-assembly comprising:

a cable reel having a first flange, a second flange, and a tubular body extending between the first flange and the second flange, wherein the first flange and the second flange each define a main opening and flange notches;

a first pad and a second pad, each of the first pad and the second pad defining a central opening and pad notches;

a first plug extending through the central opening of the first pad and the main opening of the first flange; and a second plug extending through the central opening of the second pad and the main opening of the second flange.

8. The cable reel assembly as in claim 7, wherein the corrugated container is one of a paper corrugated container and a plastic corrugated container.

9. The cable reel assembly as in claim 8, wherein the tubular body defines a keyhole having an opening portion and a slot portion extending from the opening portion.

10. The cable reel assembly as in claim 7, wherein the cable reel sub-assembly is movable between a restricted position and an unrestricted position within the corrugated container.

11. The cable reel assembly as in claim 10, wherein the flap extends into the flange notches and the pad notches such that the cable reel is restricted from movement relative to the first pad and the second pad when in the restricted position.

12. The cable reel assembly as in claim 10, wherein the cable reel is permitted to move relative to the first pad and the second pad when in the unrestricted position.

13. The cable reel assembly as in claim 7, wherein the cable reel is rotatable about the first plug and the second plug relative to the first pad and the second pad between an aligned position and an unaligned position, wherein the pad notches are aligned with the flange notches in the aligned position.

14. The cable reel assembly as in claim 13, wherein the flap is removably insertable into the flange notches and the pad notches when the cable reel is in the aligned position.

15. The cable reel assembly as in claim 7, wherein the first pad and the second pad each define an edge, wherein the pad notches defined in the first pad and the second pad each extend from a respective edge.

16. The cable reel assembly as in claim 7, wherein the first flange and the second flange each define a periphery, and wherein the flange notches defined in the first flange and the second flange each extend from a respective periphery.

17. The cable reel assembly as in claim 7, wherein at least one of the first pad and the second pad define a pad fastener hole, and wherein at least one of the first flange and the second flange define a flange fastener hole that is alignable with the pad fastener hole.

18. A method of locking a cable reel assembly, the method comprising:

moving a cable reel relative to a first pad and a second pad until a pad notch defined on one of the first pad and the second pad aligns with a flange notch defined on a flange of the cable reel; and inserting a flap of a corrugated container into the pad notch and the flange notch to restrict movement between the cable reel and the first and second pads.

19. The method as in claim 18, wherein moving the cable reel further comprises:

rotating the cable reel about a first plug and a second plug relative to the first pad and the second pad until the pad notch aligns with the flange notch.

* * * * *